US006065178A

United States Patent [19]

Hsieh

[11] Patent Number: 6,065,178

[45] Date of Patent: May 23, 2000

[54] SEPARATE TYPE SPONGE MOP

[76] Inventor: Ming Ti Hsieh, No. 828, Jang Fong Road, Tou Fen chang, Miao Li Hsien, Taiwan

[21] Appl. No.: 09/195,142

[22] Filed: Nov. 18, 1998

[51] Int. Cl.[7] ..... A47L 13/257

[52] U.S. Cl. ..... 15/244.2; 15/244.1

[58] Field of Search ..... 15/244.1, 244.2, 15/228, 171, 173, 231, 147.1

[56] References Cited

U.S. PATENT DOCUMENTS 2,770,828 11/1956 Ellman .
2,844,837 7/1958 Mackert .
3,041,651 7/1962 Jardine .
3,465,377 9/1969 Thomas .

*Primary Examiner*—Robert J. Warden, Sr.
*Assistant Examiner*—Jennifer C. McNeil
*Attorney, Agent, or Firm*—Rosenberg, Klein & Lee

[57] ABSTRACT

The invention disclosed a separate type sponge mop that comprises a main body, a sponge, a handle, and fixing mechanisms. The main body is a flat plate with a socket disposed on the top, which socket is pivotally connected with the handle. The main body is further provided with a fixing mechanism arranged near two sides of the socket. By means of the fixing mechanisms, sponges can be attached to the bottom face of the main boy. The fixing mechanism is composed of a hollow set piece and a rotary rod. The set piece is open on the top and has thread grooves formed on the cylindrical peripheral surface. The rotary rod extends through the central hole of the set piece and the main body and is connected with an attachment plate and a fastener on the other end. The sponge has a locating slot on two widthwise sides of the bottom face and a connection slot on two ends. Users can first turn the rotary rod to move the attachment plates downwardly. Then they place the sponge on the attachment plate. After that, users turn the rotary rod in reverse to clamp the sponge on the main body. Thus the invention can provide the advantage of simple mounting and dismounting sponges.

1 Claim, 3 Drawing Sheets

SEPARATE TYPE SPONGE MOP

BACKGROUND OF INVENTION

The invention relates to a separate type sponge mop. It has an ingenious structure that primarily uses fixing mechanisms able to clamp or release sponge by turning a rotary rod. The invention provides the advantages of low manufacturing costs and convenience in use.

Conventional sponge mops generally have a toggle clamping mechanism gripping a sponge. The main part of the toggle clamping mechanism comprises two clamping rods, connection rails, strong springs, links, and manual levers. The toggle clamping mechanism is further assembled with a handle to form a mop. Such a structure is complicated and needs more time in assembling, resulting in a high manufacturing cost. Also, it needs a larger force to pull or press manual levers in order to clamp or release a sponge. Thus it is inconvenient for users.

In view of the above deficiency of a conventional sponge mop, it is desirable to have an innovative mop structure in which the imperfection of a conventional mop has been eliminated. Now the structure, features, functions, and advantages of the invention will be further described in detail with reference to the accompanying drawings.

BRIEF DESCRIPTION OF ACCOMPANYING DRAWINGS

DETAILED DESCRIPTION OF PREFERRED EMBODIMENTS

Figure 1:
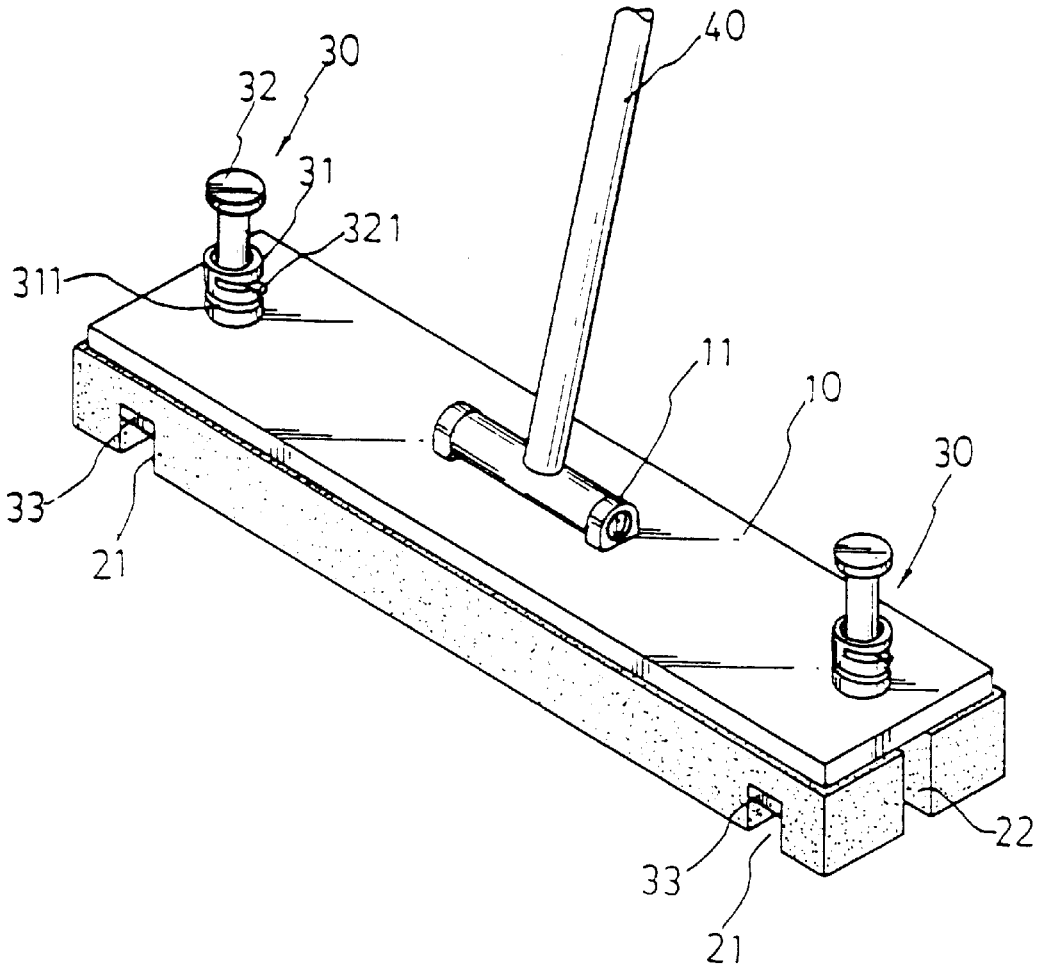
FIG. 1 is a perspective view showing an embodiment of a mop structure according to the invention.
Figure 2:
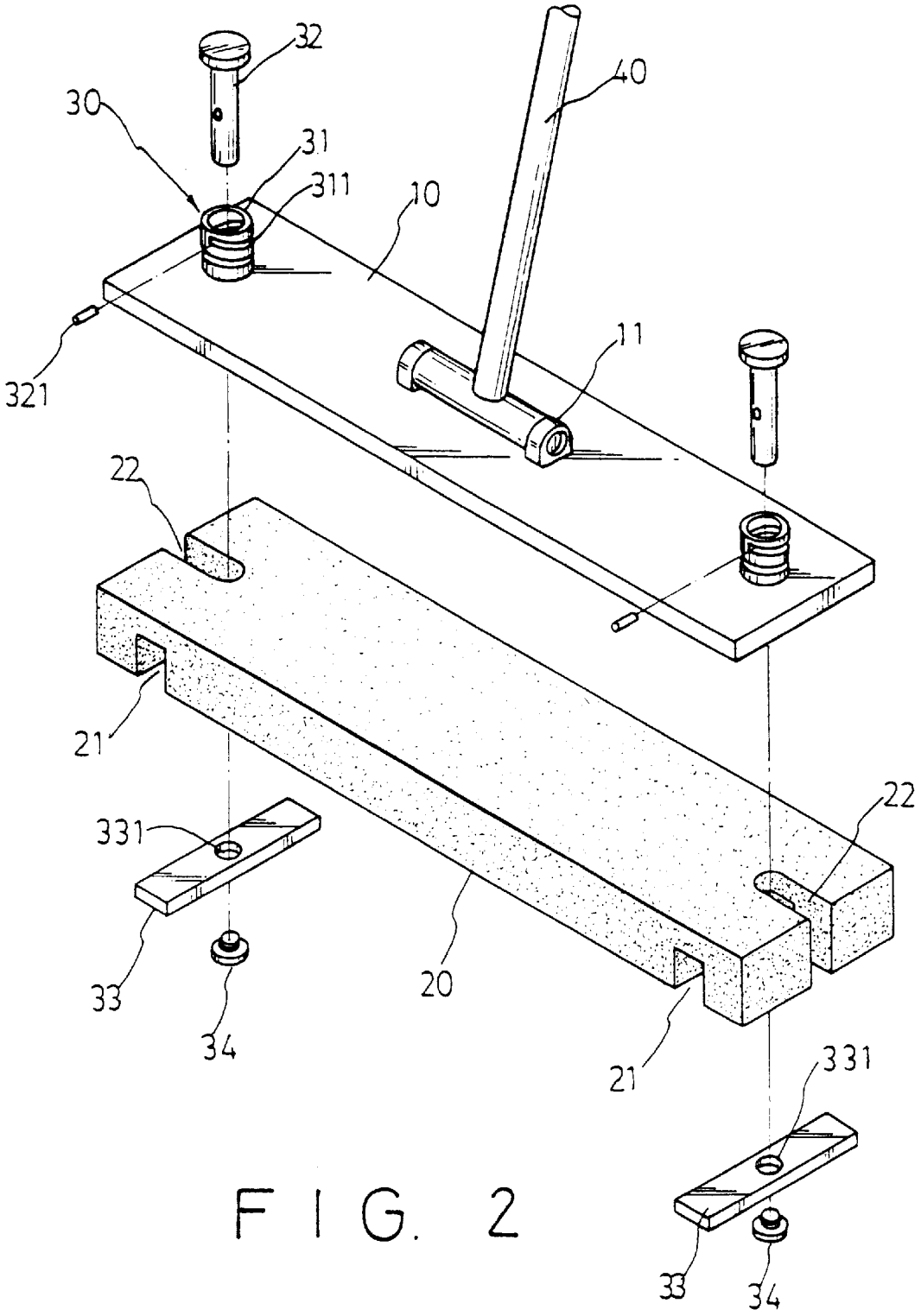
FIG. 2 is a perspective view showing the mop of FIG. 1 in an assemble state.

Referring to FIGS. 1 through 4, the mop according to the invention comprises a main body (10), a sponge (20), a fixing mechanism (30), and a handle (40). The main body (10) is a flat plate with a socket (11) disposed at the central region thereof. The socket (11) can receive a handle (40) therein and allow it to rotate freely. The main body is further provided respectively on two sides of the socket (11) with a fixing mechanism (30), which is joined with the main body (10) by a cylindrical hollow set piece (31). The set piece (31), extending through the main body (10), is open on the top and has a continuous thread groove (311) formed on the peripheral cylindrical surface thereof. A rotary rod (32) extends from the top end of the set piece (31) to the bottom end and is joined with an attachment plate (33) at the lower end. A set pin (321) is provided on the cylindrical surface of the rotary rod (32) and extends into the thread groove (311) of the set piece (31), by means of which set pin turning the rotary rod (32) can move the rod (32) up and down along the thread groove. The attachment plate (33) is sized to be housed in the locating slot (21) of the sponge (20) and has a connection opening (331) arranged on the central area thereof. After passing through the hollow set piece (31), the body of the rotary rod (32) continues to extend through the central opening (331) of the attachment plate (33). The rotary rod (32) is joined with a fastener (34) on the lower end in a way that can allow the rotary rod (32) to freely rotate without bringing the attachment plate (33) to move. The sponge (20) has two locating slots (21) respectively disposed on two opposite widthwise sides at a position corresponding to the attachment plates (33) and an open-ended connection slot (22) arranged at a central position on each widthwise side. With such arrangement the sponge can be easily mounted on the main body (10).

Figure 3:
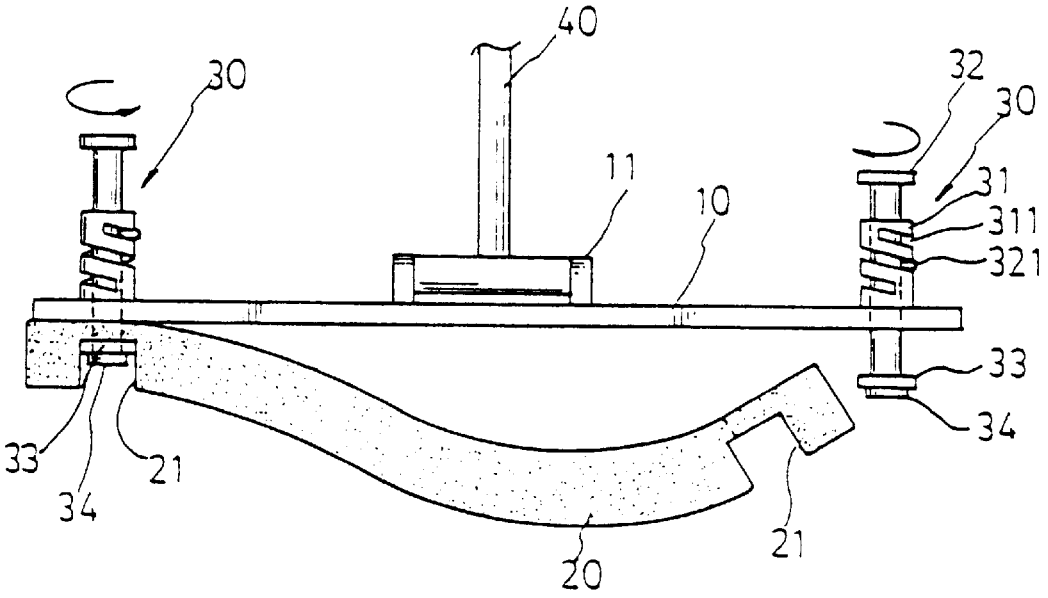
FIGS. 3 and 4 are front views schematically illustrating the mounting of a sponge.
Figure 4:
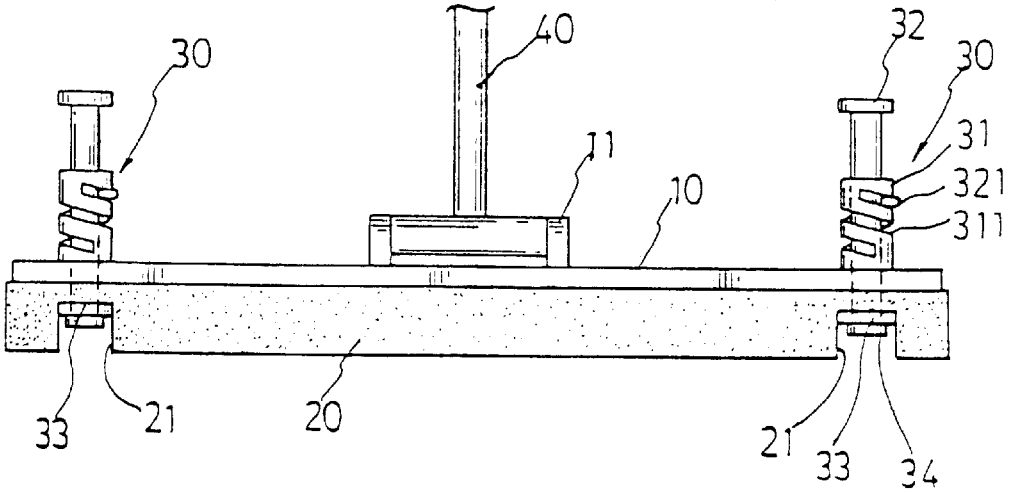

As can be seen from FIGS. 3 and 4, the sponge of the sponge mop according to the invention can be mounted in an easy way. First, users can turn the rotary rod (32) to move it downwardly until a space greater than the thickness of the sponge is formed between the attachment plate (33) and the main body (10). Next, users put a sponge (20) on the attachment plate (33), with the connection slots (22) embracing the rotary rod between the attachment plate (33) and the main body (10) and the attachment plate (33) placed in the locating slots (21). After that, users rotate the rotary rod (32) in reverse to raise the attachment plate (33) until the sponge (20) is firmly attached to the main body (10). The movement of the rotary rod (32) is constrained by the set pin (321) and so it can only rotate to move up and down. Therefore, no matter how large the weight of the sponge is, the rotary rod (32) will not be caused to move by the weight. In other words, unless the rotary rod (32) is turned intentionally by a manual operation, it is impossible to get the clamping of the attachment plate (33) loosened. When dismounting the sponge (20) is desired, users only need to turn the rotary rod (32) in a reverse direction and the sponge can be easily detached from the main body. Therefore, the invention can provide the advantages of convenience in use. It can achieve the object of reducing manufacturing costs and has the practical value in the industry.

From the above description, evidently the invention can reach the object set forth at the beginning. It meets the essence of a patent. We hereby file an application for a grant of a patent.

What is claimed is:

1. A separate type sponge mop comprising a main body, a sponge, fixing mechanisms, and a handle wherein said main body is a flat plate with a socket disposed at the central area of the top thereof to pivotally connect with said handle and is further provided respectively on two sides of said socket with a fixing mechanism, which is joined with the main body by a cylindrical hollow set piece, said set piece having a continuous thread groove formed on the cylindrical peripheral surface thereof and being open on the top to receive a rotary rod that extends from the top of the set piece through the main body to the bottom end of the set piece and connects with an attachment plate at the lower end by a fastener, said rotary rod having a set pin provided on the cylindrical surface thereof, which set pin extends into the thread groove of said set piece, said sponge having two locating slots respectively disposed on two opposite sides at a position corresponding to the attachment plates and an open-ended connection slot arranged at a central position on each side;

and characterized in that said sponge is mounted on the attachment plate by arranging connection slots to embrace said rotary rod between the attachment plate and the attachment plate placed in the locating slots and turning the rotary rod to rise the attachment plate until the sponge is clamped between the attachment plate and the main body.

* * * * *